US005846071A

United States Patent [19]

Sigler

[11] Patent Number: 5,846,071

[45] **Date of Patent: *Dec. 8, 1998**

[54] BURNER CONSTRUCTION COOKING APPARATUS UTILIZING THE BURNER

[75] Inventor: Kent K. Sigler, New Stanton, Pa.

[73] Assignee: Robertshaw Controls Company, Richmond, Va.

[ * ] Notice: The term of this patent shall not extend beyond the expiration date of Pat. No. 5,620,317.

[21] Appl. No.: 822,641

[22] Filed: Mar. 18, 1997

Related U.S. Application Data

[63] Continuation of Ser. No. 386,010, Feb. 9, 1995, Pat. No. 5,620,317.

[51] Int. Cl.[6] ..... F23Q 3/00

[52] U.S. Cl. ..... 431/266; 126/39 R; 126/39 H; 239/567

[58] Field of Search ..... 431/264, 266; 126/39 R, 39 H, 39 N; 239/552, 554, 567

[56] References Cited

U.S. PATENT DOCUMENTS

| | | | |
|---|---|---|---|
| 746,992 | 12/1903 | Rice . | |
| 873,182 | 12/1907 | Springer et al. . | |
| 2,348,011 | 5/1944 | Koppel . | |
| 2,372,953 | 4/1945 | Hurlbut et al. | 239/567 |
| 2,539,101 | 1/1951 | Reeves . | |
| 2,615,510 | 10/1952 | James et al. . | |
| 4,943,232 | 7/1990 | Lin . | |
| 5,266,026 | 11/1993 | Riehl . | |
| 5,620,317 | 4/1997 | Sigler | 431/266 |

FOREIGN PATENT DOCUMENTS

| | | |
|---|---|---|
| 834748 | 3/1952 | Germany . |

*Primary Examiner*—Carroll B. Dority
*Attorney, Agent, or Firm*—Fulbright & Jaworski L.L.P.

[57] ABSTRACT

A burner construction, a cooking apparatus utilizing the burner construction and methods of making the same are provided, the burner construction comprising a burner body having an open end and a removable cap closing the open end of the burner body, the burner body having an annular surface interrupted by a plurality of radially disposed and spaced apart grooves that are closed by the cap to define ports through which fuel can issue to burn externally to the burner construction, the annular surface of the burner body comprising an annular flange that extends radially outwardly from the one end of the burner body.

9 Claims, 4 Drawing Sheets

BURNER CONSTRUCTION COOKING APPARATUS UTILIZING THE BURNER

CROSS-REFERENCE TO RELATED APPLICATION

This application is a continuation of application Ser. No. 08/386,010, filed Feb. 9, 1995 and now U.S. Pat. No. 5,620,317.

BACKGROUND OF THE INVENTION

1. Field of the Invention

This invention relates to a new burner construction and to a new cooking apparatus utilizing such a burner construction as well as to a new method of making such a burner construction and a new method of making such a cooking apparatus.

2. Prior Art Statement

It is known to provide a burner construction comprising a burner body means having a chamber means therein and having opposed end means one of which is opened to the chamber means and the other of which has means for interconnecting a source of fuel to the chamber means, and a removable cap means closing the one end means of the body means, the burner construction having port means interconnecting the chamber means to the exterior of the burner construction and through which the fuel can issue to burn externally to the burner construction, the body means having an annular surface means interrupted by a plurality of radially disposed and spaced apart groove means that have open ends and closed ends, the cap means having an annular surface means cooperating with the annular surface means of the body means to close the open ends of the groove means whereby the groove means define the port means. For example, see the U.S. patent to Riehl, U.S. Pat. No. 5,266,026.

SUMMARY OF THE INVENTION

It is one of the features of this invention to provide a burner construction wherein the burner body means thereof can be formed in a relatively inexpensive and simple manner to provide an annular surface means at the open end of the burner means which cooperates with an annular surface means of a cap means that closes the open end of the body means and provide port means therewith through which fuel can issue from the burner body means to burn externally to the burner construction.

In particular, it is believed according to the teachings of this invention that the annular surface means of the burner body means can comprise an annular flange means that extends radially outwardly from the one end of the burner body means and can have a plurality of radially disposed and spaced apart groove means interrupting the same so that the open ends of the grooves can be closed by the cap means and cooperate therewith to define the port means of the burner construction.

For example, one embodiment of this invention comprises a burner construction comprising a burner body means having a chamber means therein and having opposed end means one of which is open to the chamber means and the other of which has means for interconnecting a source of fuel to the chamber means, and a removable cap means closing the one end means of the body means, the burner construction having port means interconnecting the chamber means to the exterior of the burner construction and through which the fuel can issue to burn externally to the burner construction, the body means having an annular surface means interrupted by a plurality of radially disposed and spaced apart groove means that have open ends and closed ends, the cap means having an annular surface means cooperating with the annular surface means of the body means to close the open ends of the groove means whereby the groove means define the port means, the annular surface means of the burner body means comprising an annular flange means that extends radially outwardly from the one end of the burner body means.

Accordingly, it is an object of this invention to provide a new burner construction having one or more of the novel features of this invention as set forth above or hereinafter shown or described.

Another object of this invention is to provide a new method of making such a burner construction, the method of this invention having one or more of the novel features of this invention as set forth above or hereinafter shown or described.

Another object of this invention is to provide a new cooking apparatus that utilizes such a burner construction, the cooking apparatus of this invention having one or more of the novel features of this invention as set forth above or hereinafter shown or described.

Another object of this invention is to provide a new method of making such a new cooking apparatus, the method of this invention having one or more of the novel features of this invention as set forth above or hereinafter shown or described.

Other objects, uses and advantages of this invention are apparent from a reading of this description which proceeds with reference to the accompany drawings forming a part thereof and wherein:

DESCRIPTION OF THE PREFERRED EMBODIMENT

Figure 1:
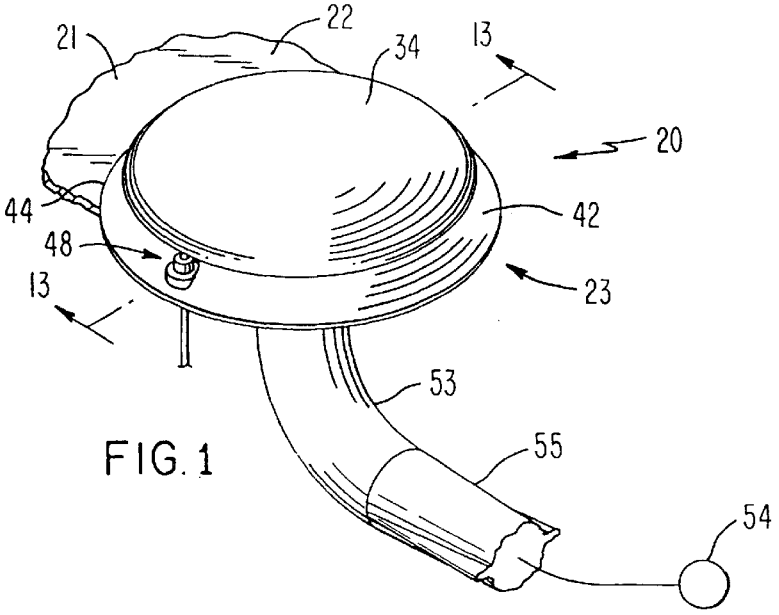
FIG. 1 is a fragmentary perspective view of the new cooking apparatus of this invention utilizing the new burner construction of this invention.

While the various features of this invention are hereinafter illustrated and described as being particularly adapted to provide a burner construction for being sealed to the range top of a cooking apparatus, it is to be understood that the various features of this invention can be utilized singly or in various combinations thereof to provide a burner construction for other apparatus as desired.

Therefore, this invention is not to be limited to only the embodiment illustrated in the drawings, because the drawings are merely utilized to illustrate one of the wide variety of uses of this invention.

Figure 13:
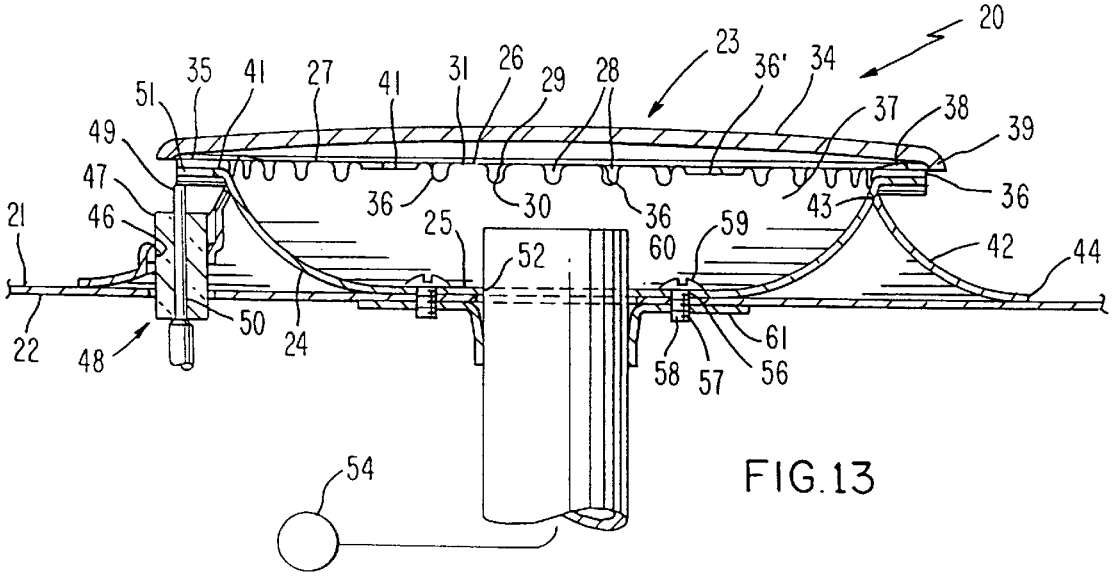
FIG. 13 is an enlarged fragmentary cross-sectional view taken on line 13—13 of FIG. 1 and illustrates the new burner construction of this invention secured to the support means of the cooking apparatus.

Referring now to FIGS. 1 and 13, the new cooking apparatus of this invention is generally indicated by the reference numeral 20 and comprises a support means 21 that provides a top surface means 22 for the cooking apparatus 20 and on which one or more sealed burner constructions of this invention are mounted, the sealed burner construction of this invention being generally indicated by the reference numeral 23.

The burner construction 23 comprises a burner body means 24 that has been formed from a flat sheet 25', FIG. 2, of metallic material in a manner hereinafter described so as to be substantially bowl shaped and having a closed end 25 and an open end 26, the burner body means 24 having an annular surface means 27 interrupted by a plurality of radially disposed and spiced apart groove means 28 that have open ends 29 and closed ends 30. The annular surface means 27 of the burner body means 24 comprises an annular flange means 31 that has an inner peripheral edge means 32 interconnected to the open end 26 of the burner body means 24 and an outer peripheral edge means 33 that extends radially outwardly from the inner edge means 32, the annular flange means 31 being one-piece and homogeneous with the burner body means 24 as the same is formed from the flat sheet 25' of metallic material at the same time the burner body means 24 is being formed therefrom.

The burner construction 23 also comprises a metallic cap means 34 that has an annular surface means 35 that effectively closes the open ends 29 of the groove means 28 when the cap means 34 is disposed on the open end 26 of the burner body means 24 as illustrated in FIGS. 1 and 13 so that the closed groove means 28 define a plurality of port means 36 through which fuel can exit from a chamber means 37 formed in the burner body means 24 and being closed by the cap means 34 for burning externally of the burner construction 23 in a manner well known in the art. For example, see the aforementioned U.S. patent to Riehl, U.S. Pat. No. 5,266,026 which is being incorporated into this disclosure by this reference thereto.

Figure 6:
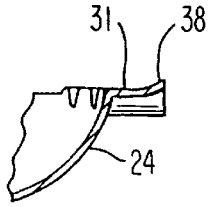
FIG. 6 is an enlarged fragmentary cross-sectional view taken on line 6—6 of FIG. 5.
Figure 5:
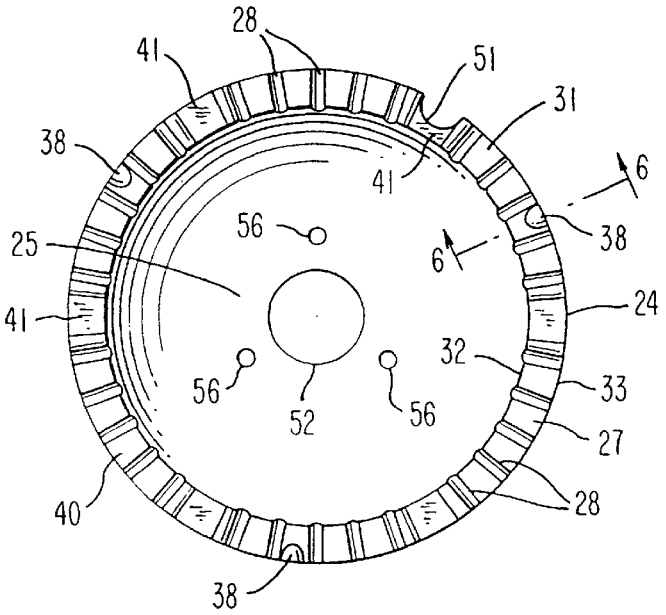
FIG. 5 is a top view of the burner body means of FIG. 4 and is taken in the direction of the arrows 5—5 of FIG. 4.

In order to hold the cap means 34 in a coaxial relation on the burner body means 24, the annular flange 31 of the burner body means 24 can have a plurality of spaced apart and upturned projections 38 formed adjacent the outer peripheral edge means 33 thereof as illustrated in FIGS. 5 and 6 to catch against a turned edge means 39 of the cap 34 as illustrated in FIG. 13 to prevent the cap 34 from being moved sideways relative to the burner body means 24.

While the groove means 28 in the annular flange means 31 of the burner body means 24 can be arranged in any suitable pattern, the same are generally uniformly spaced from each other by land means 40 of the annular flange 31 except that every so often a larger land means 41 is provided which is depressed below the annular surface of the regular land means 40 to provide a flame carry-over function and would be normally disposed adjacent a leg of a burner grate that would be set over the burner construction 23 and engage against the top surface 22 of the support means 21 of the cooking apparatus 20 for supporting a cooking pot or the like above the burner construction 23 in a conventional manner.

The burner construction 23 of this invention also comprises a bezel ring 42 that has an inner peripheral edge means 43 and outer peripheral edge means 44 so that the outer peripheral edge means 44 can be disposed against the surface 22 of the support means 21 of the cooking apparatus 20 as illustrated in FIG. 13 and the inner edge means 43 thereof will closely surround the burner body means 24 as illustrated in FIG. 13.

The bezel ring 42 is also formed from a flat sheet 45, FIG. 7, of metallic material in a manner hereinafter set forth so that the same comprises a stamped structure having the configuration illustrated in the drawings and during the forming of the bezel ring 42, an igniter holding opening means 46 is formed in the bezel ring 42 so that a cylindrical insulating member 47 of an igniter structure 48 can be press fit into the opening means 46 and position an outer end 49 of a metallic electrode 50 in spaced relation to the cap means 34 as a cooperating land 41 of the annular flange 31 of the burner body means 24 has a cutout 51 formed therein to permit sparking from the electrode end 49 to the cap 34 to ignite the fuel issuing from the port means 36 all in a manner well known in the art.

The closed end 25 of the burner body means 24 is provided with a central opening 52 through which a fuel supplying conduit 53 can extend in the manner illustrated in FIG. 13 to supply fuel to the chamber means 37 from a fuel source 54, the conduit means 53 having a suitable venturi means 55 for drawing primary air into the conduit means 53 to mix with the fuel before the same reaches the chamber means 37 all in a manner well known in the art.

In order to secure the burner body means 24 to the support means 21 of the cooking apparatus 20, the closed end 25 of the burner body means 24 has a plurality of openings 56 formed therethrough and disposed in a spaced apart circular array about the central opening 52 and through which the shank portions 57 of a plurality of fastening means 58 extend so that the enlarged heads 59 of the fastening members 58 will compact against the closed end 25 of the burner body means 24 while the threaded shanks 57 thread through suitable openings 60 in the support structure 21 and fastened to the threads of a bracket means 61 that holds the conduit means 53 in an aligned relation relative to the burner body means 24 as illustrated in FIG. 13. Of course, suitable sealing gasket means can be provided between the sandwiched structure that holds the burner body means 24 to the support structure 21 all in a manner well known in the art.

Before the burner body means 24 is secured to the support structure 21, the bezel ring 42 is disposed in place on the support structure 21 so as to be trapped between the support structure 21 and the burner body means 24 when the closed end 25 thereof is subsequently fastened against the support structure 21 by the fastening means 58 in the manner previously set forth.

Figure 2:
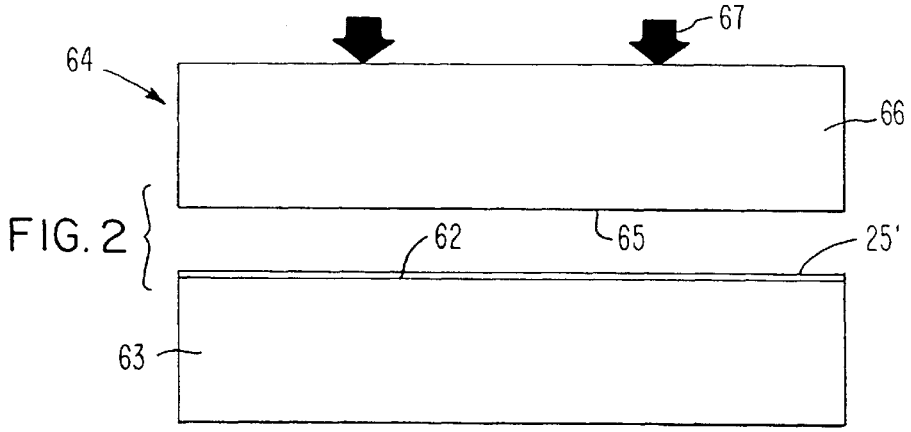
FIG. 2 is a schematic end view illustrating how a flat sheet of metallic material is to be disposed in a die means to form the burner body means of the burner construction of FIG. 1 when the die means of FIG. 2 have been closed in the manner illustrated in FIG. 3.
Figure 3:
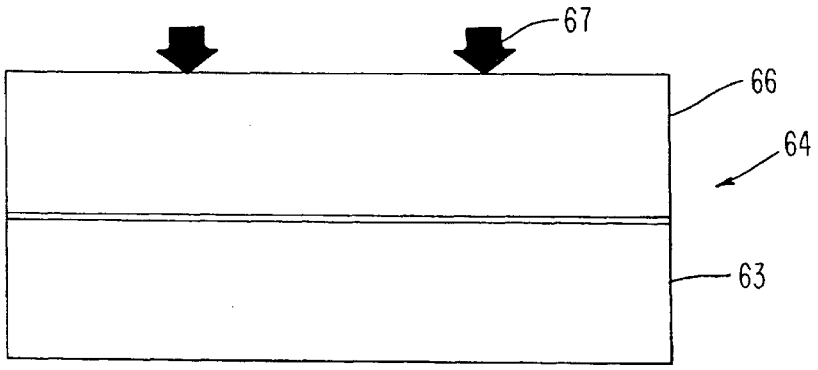
FIG. 3 is a view similar to FIG. 2 and illustrates the die means of FIG. 2 in a closed condition thereof.
Figure 4:
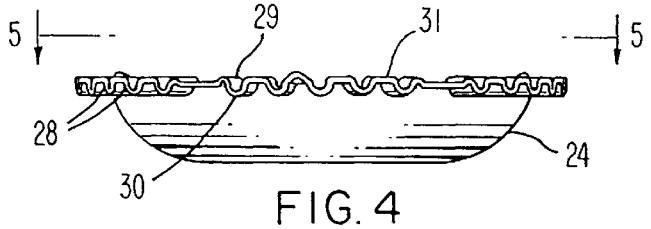
FIG. 4 is a side view of the burner body means of the burner construction of FIG. 1 that has been formed by the die means of FIGS. 2 and 3.

As illustrated in FIGS. 2 and 3, the flat sheet 25' of metallic material is disposed on a forming surface 62 of a die 63 of a stamping apparatus 64 so that when a forming surface 65 of another die 66 is closed against the die 63 in the direction of the arrows 67 in FIGS. 2 and 3, the sheet 25' of metallic material is formed or stamped into the configuration of the burner body means 24 illustrated in FIGS. 4, 5 and 6 by a simple stamping and cutting operation that is well known in the die forming art.

Figure 7:
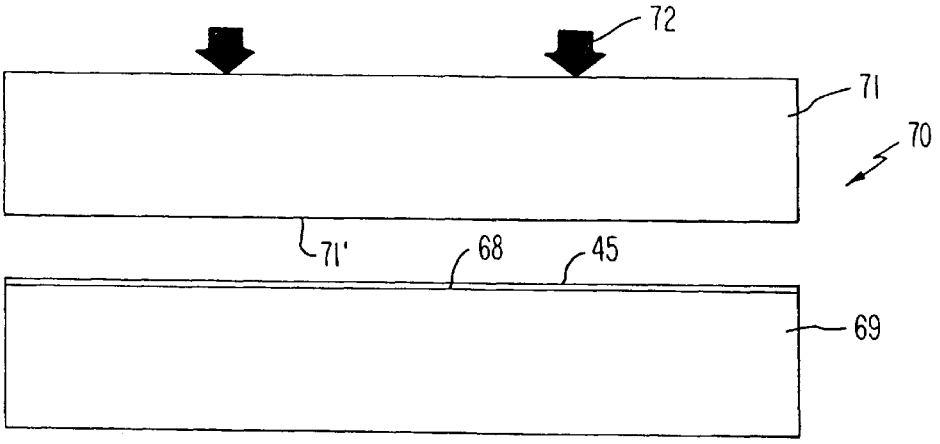
FIG. 7 is a view similar to FIG. 2 and illustrates another pair of die means for forming a flat sheet of metallic material into a bezel ring for the burner construction of FIG. 1.
Figure 8:
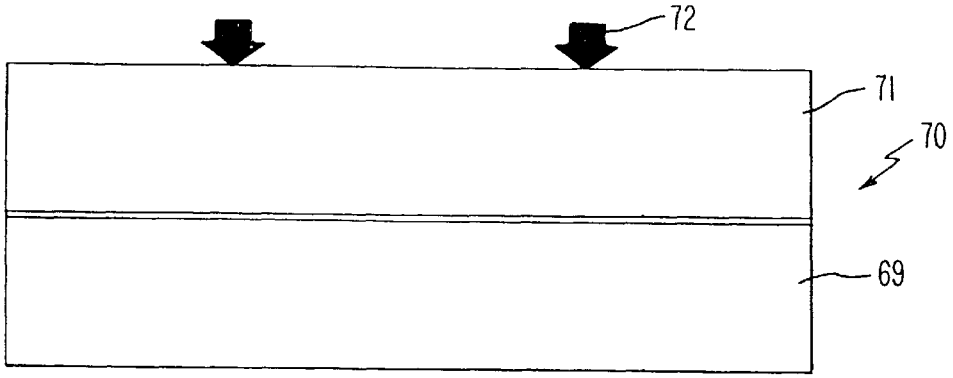
FIG. 8 is a view similar FIG. 7 and illustrates the die means of FIG. 7 in a closed condition thereof.
Figure 9:
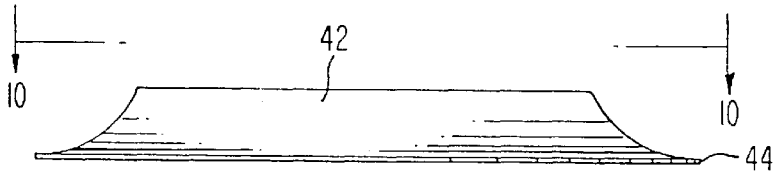
FIG. 9 is a side view of the bezel ring formed from the die means of FIGS. 7 and 8.
Figure 11:
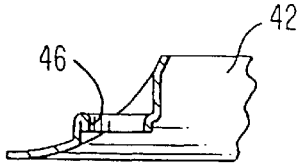
FIG. 11 is an enlarged fragmentary cross-sectional view taken on line 11—11 of FIG. 10.
Figure 10:
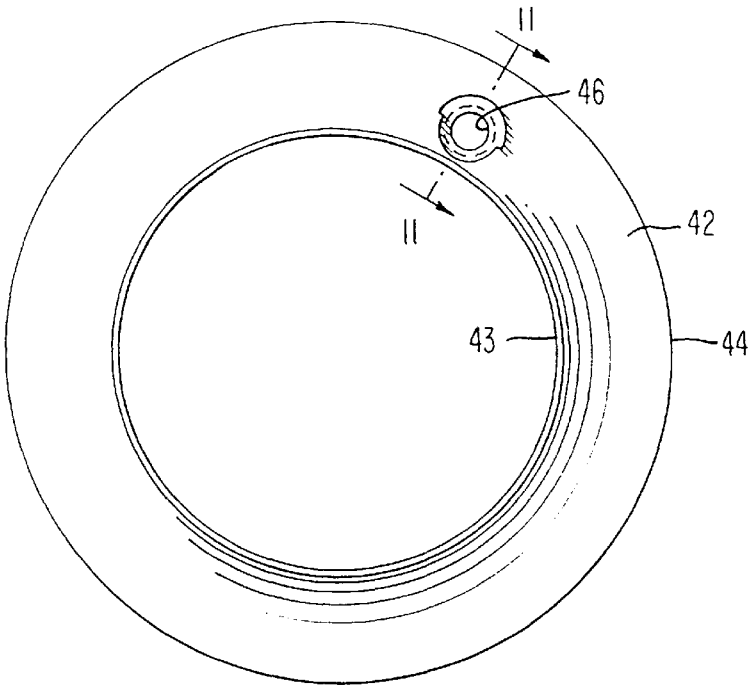
FIG. 10 is a top view of the bezel ring of FIG. 9 and is taken in the direction of the arrows 10—10 of FIG. 9.
Figure 12:
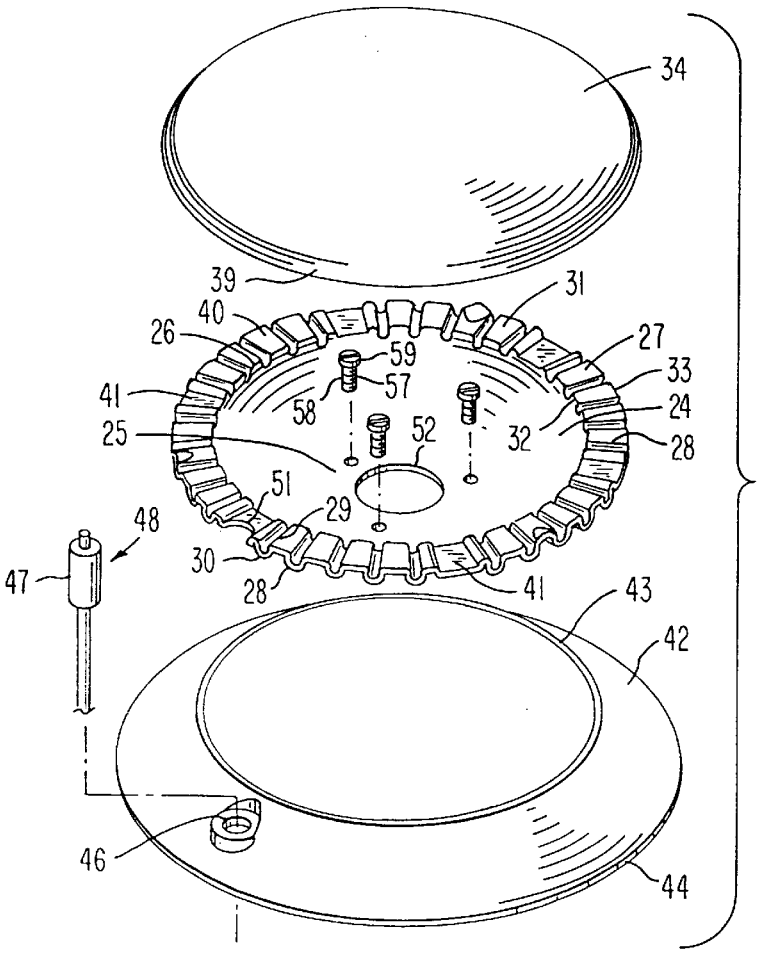
FIG. 12 is an exploded perspective view of the various parts that form the burner construction of this invention.

Similarly, when the sheet 45 of metallic material is disposed on the forming surface 68 of a die 69 of another stamping apparatus 70 as illustrated in FIG. 7, the forming surface 71' of another die 71 when moved in the direction of the arrows 72 in FIGS. 7 and 8 against the die 69 forms the sheet 45 into the bezel ring 42 by a simple stamping and cutting operation.

Thus, it can be seen that when forming the burner body means 24 and the bezel ring 42 for each burner construction 23 of this invention, a relatively simple method of making the same is provided by the method of this invention.

Further, it can be seen that the method of making the burner construction 23 of this invention from the burner body means 24, the bezel ring 42 and the cap 34 is a relatively simple operation as the burner body means 24 can be secured to the support structure 21 of the cooking apparatus 20 by a simple threading operation of the fastening members 58 in the manner previously described so that the cap means 34 will cooperate with the burner body means 24 to form the ports 36 through which fuel will issue in a simple and effective manner, the carry-over lands 41 of the flange means 31 of the burner body means 24 cooperating with the annular surface 35 of the cap means 34 to provide the carry over ports 36' illustrated in FIG. 13 and being utilized for the same purpose as the carry-over slots or ports disclosed in the aforementioned U.S. patent to Riehl, U.S. Pat. No. 5,266,026.

While the burner body means 24 and bezel ring 42 can be formed of any suitable material, it is believed that the sheets of material 25' and 45 can each comprise 0.032 of an inch thick decarb steel and the diameter of the outer peripheral edge means 33 of the burner body means 24 can be approximately 3.500", the outer peripheral edge means 44 of the bezel ring 42 can be approximately 4.400" and the inner peripheral edge means 43 of the bezel ring 42 can be approximately 2.975".

However, it is to be understood that the aforementioned dimensions are not to be a limitation on this invention as the same are merely given as being one possible working embodiment of this invention.

In view of the above, it can be seen that this invention not only provides a new burner construction and a new cooking apparatus utilizing such a burner construction, but also this invention provides a new method of making such a new burner construction and a new method of making such a new cooking apparatus.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. A burner construction, comprising:

a burner body defining a chamber having means for connecting to a fuel source and an outer rim which includes a substantially flat flange having a plurality of grooves;

a cap having a substantially flat surface for releasably engaging said burner body about said flange;

a plurality of ports formed between said grooves and said cap a bezel ring and an igniter structure wherein said bezel ring contains an opening for said igniter structure.

2. A burner construction as recited in claim 1, wherein said burner body comprises a stamped homogeneous one-piece member.

3. A burner construction as recited in claim 1, wherein the substantially flat flange includes a plurality of projections adjacent to the outer edge of the flange; and wherein the perimeter of said cap includes a turned down edge for releasably engaging said plurality of projections and holding the cap coaxially on the body.

4. A burner construction as recited in claim 1, wherein said plurality of grooves are separated by at least one means for providing a flame carry-over function.

5. A burner construction as recited in claim 1, further comprising said bezel ring surrounding the outside of the body and one end of the body.

6. A burner construction as recited in claim 5, wherein said bezel ring is a stamped structure.

7. A cooking apparatus, comprising a means for providing support;

a burner body defining a chamber having means for connecting to a fuel source and an outer rim which includes a substantially flat flange having a plurality of grooves;

a cap having a substantially flat surface for releasably engaging said burner body about said flange;

a plurality of ports formed between said grooves and said cap a bezel ring and an igniter structure wherein said bezel ring contains an opening for said igniter structure.

8. A burner construction, comprising:

a burner body defining a chamber having means for connecting to a fuel source and an outer rim which includes a substantially flat flange having a plurality of grooves;

a cap having a substantially flat surface for releasably engaging said burner body about said flange; the substantially flat flange includes a plurality of projections adjacent to the outer edge of the flange; the perimeter of said cap includes a turned down edge for releasably engaging said plurality of projections and holding the cap coaxially on the body;

a plurality of ports formed between said grooves and said cap; and a bezel ring surrounding the outside of the body and one end of the body.

9. A burner construction, comprising:

a burner body defining a chamber having means for connecting to a fuel source and an outer rim which includes a substantially flat flange having a plurality of grooves;

a cap having a substantially flat surface for releasably engaging said burner body about said flange;

a plurality of ports formed between said grooves and said cap;

the substantially flat flange including a plurality of projections adjacent to the outer edge of the flange; and wherein the perimeter of said cap includes a turned down edge for releasably engaging said plurality of projections and holding the cap coaxially on the body.

* * * * *